United States Patent [19]

Barbour

[11] Patent Number: 5,022,683

[45] Date of Patent: Jun. 11, 1991

[54] CHECK INSERT AND ENVELOPE

[76] Inventor: William P. Barbour, 8021 Nicky Crt., Laurel, Md. 20707

[21] Appl. No.: 412,512

[22] Filed: Sep. 26, 1989

[51] Int. Cl.[5] ..... B42D 15/00

[52] U.S. Cl. ..... 283/58; 283/116; 281/2; 229/71

[58] Field of Search ..... 283/67, 57, 58, 59, 283/116; 229/71, 73; 281/2, 5

[56] References Cited

U.S. PATENT DOCUMENTS

| | | | |
|---|---|---|---|
| 1,265,159 | 5/1918 | Alexander . | |
| 1,371,670 | 3/1921 | Dority et al. | 283/116 |
| 1,932,536 | 10/1933 | Standal et al. . | |
| 2,209,601 | 7/1940 | Heywood . | |
| 2,559,776 | 7/1951 | Larzelere . | |
| 2,693,909 | 11/1954 | Allan | 283/58 |
| 2,747,894 | 5/1956 | Porter | 281/2 |
| 2,777,631 | 1/1957 | Zalkind | 283/117 |
| 2,831,707 | 11/1957 | James, Jr. et al. . | |
| 2,858,061 | 11/1957 | Fromm et al. . | |
| 2,983,431 | 7/1958 | Turan . | |
| 2,985,464 | 5/1961 | McFarland . | |
| 3,141,603 | 4/1962 | Whitman . | |
| 3,531,628 | 9/1970 | White, Jr. . | |
| 3,576,972 | 5/1971 | Wood . | |
| 3,593,913 | 7/1971 | Bremer . | |
| 3,666,926 | 5/1972 | Corte, Jr. et al. | 283/116 |
| 3,672,703 | 6/1972 | Jay | 283/58 |
| 3,702,924 | 11/1972 | Wood et al. . | |
| 3,790,193 | 2/1974 | McBird | 283/57 |
| 3,802,618 | 4/1974 | Wiessner . | |
| 3,838,808 | 10/1974 | Schroeder . | |
| 3,895,220 | 7/1975 | Nelson et al. . | |
| 4,089,418 | 5/1978 | Yale | 229/73 |
| 4,128,202 | 12/1978 | Buros . | |
| 4,585,160 | 4/1986 | Fiske, II | 283/58 |
| 4,615,480 | 10/1986 | Powell . | |
| 4,636,099 | 1/1987 | Goldstone | 281/2 |
| 4,828,104 | 5/1989 | Ribellino, Jr. . | |
| 4,927,071 | 5/1990 | Wood | 229/71 |

*Primary Examiner*—Frank T. Yost
*Assistant Examiner*—Hwei-Siu Payer
*Attorney, Agent, or Firm*—A. Donald Messenheimer

[57] ABSTRACT

For periodic billing of merchandise, utilities, services or the like, the billing organization prepares and sends to the customer a unique bill (10) which has diecuts (18) and (20) located to position a personal check of conventional size on the bill in a position so that the dollar amounts on the bill and on the check are in juxtaposition. A preaddressed envelope of the same size as the bill is prepared with a window at the return address position so located that the address identification information on the check appears in the envelope window and is used as the return address.

11 Claims, 3 Drawing Sheets

CHECK INSERT AND ENVELOPE

This invention relates to a customer billing process where bill statements of amounts owed for merchandise, utilities, or services are mailed to the customer on a monthly or other periodic basis and the owed amount is paid by personal check which accompanies a portion of the bill in a second envelope preaddressed to a payment processing center.

BACKGROUND

Many organizations bill on a monthly basis to a very large customer base. Staggered billing dates throughout the month result in a steady influx of payments. Centralized payment processing centers receive hundreds of thousands of individual payments, usually by personal check, on a daily basis which must be credited to the proper account and the check must be deposited as quickly as possible for obvious economic reasons. Over the past decade or so, an industry has emerged whose products speed up the job of handling all of this mail by electronically reading the checks and the bills at speeds humans cannot begin to match. Mail opening machines to speed the extraction of bill and check from the envelope are also available.

The desire to completely automate the process of moving checks and bills directly from the envelope into reading machines has been stymied by the fact that a high percentage of personal checks come out of the envelope upside down or backward and must be properly turned before entering the highspeed reading machines. As a result, a staff of operators must be employed to do the physical removal of checks and bills from the envelopes and orient them as required.

Recently there has been a movement toward developing semi-intelligent machines that recognize the orientation of each document as it emerges from the envelope and electronically signals downstream mechanical devices to flip or roll each offending document into a correct orientation. Machines of this type are very expensive, costing hundreds of thousands of dollars. In addition, such machines are large and thereby use up valuable floor space. Most importantly they are complex in nature and difficult to maintain. Once they breakdown, the production bottleneck consequences are unacceptable.

SUMMARY OF THE INVENTION

It is an object of the present invention to encourage the bill payers of the general public to cooperate by placing the return bill and the payment check in the envelope so oriented that when the contents are removed, the check and the bill will be ready for immediate entry into remittance processing equipment.

A major object of this invention is to eliminate the need for orientating devices by so constructing the return envelope and the return bill that the great majority of bill payers will voluntarily place the bill and check in the envelope in a manner that will allow the envelope contents to emerge properly aligned for efficient processing.

Conceding that there are no means available by which the bill payer can be forced into placing return bill and a personal check in an envelope in a certain prescribed manner, the present invention produces persuasive and selfevident benefits to the responding bill payer by eliminating the need to write a return address on the envelope. As bill paying is at best an unpleasant and time consuming chore, and writing a return address is just one more time consuming task, the present invention provides a novel bill and a unique envelope which when used with conventional personal checks will encourage the bill payer to load the envelope in a prescribed manner to allow the payment processing station to receive the check and bill with an orientation that gives optimum handling efficiency.

A further detailed object of the invention is to provide a novel method of billing and collecting payments on a periodic basis.

A yet further object of the invention is to provide a novel bill with die cuts positioned to affix the payment check at a favorable position relative to bill markings and to use an envelope having an opening in the envelope at the return address position where address identification that is preprinted on a personal check will be visible.

These and other objects of the invention will become more fully apparent from the claims and from the description as it proceeds in conjunction with the accompanying drawings.

DETAILED DESCRIPTION OF PREFERRED EMBODIMENT

Figure 1:
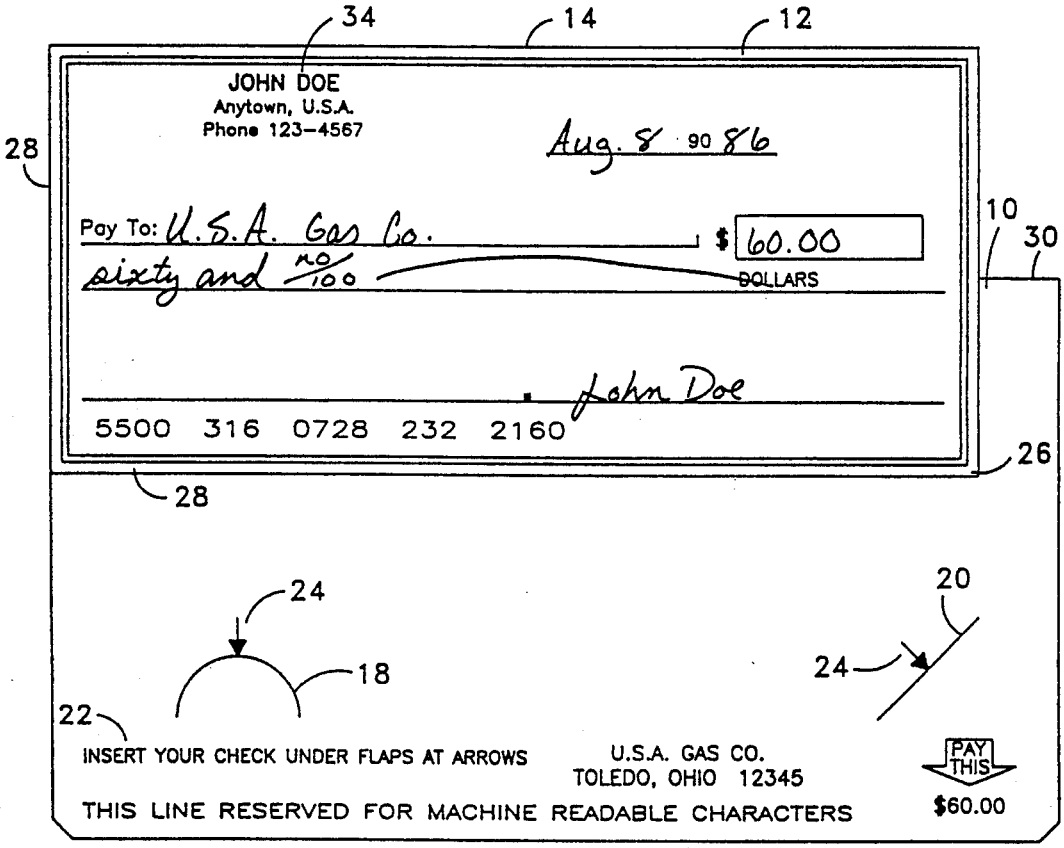
FIG. 1 is a drawing showing an unassembled payment bill according to the present invention and a personal check that is smaller than bill.

Payment bills mailed to customers for merchandise or services frequently have a tear-off sheet 10 which indicates the name of the billing organization and an amount that is due. In FIG. 1, the amount to be paid is indicated by the notation $60.00 at the lower right hand corner of the bill 10. A personal check 12 customarily measures 2.75 inches high and 6 inches long and carries address information including a name, address and telephone number which identifies the owner of the checking account. The address identification information is placed on the check along the upper marginal edge 14 between the left marginal edge 16 and the center of the check. Usually the address identification information is printed in three or four lines and thus is uniformly located within a reasonably well defined area 34.

The novel bill 10 of the present invention contains a bottom support slit 18 and a corner slit 20. Through the use of printed instructions 22 and arrows 24, the user is instructed to slit the lower right hand corner 26 of check 12 into corner slit 20 and the lower marginal edge 28 of check 12 under the flap of the bottom support slit 18.

Figure 2:
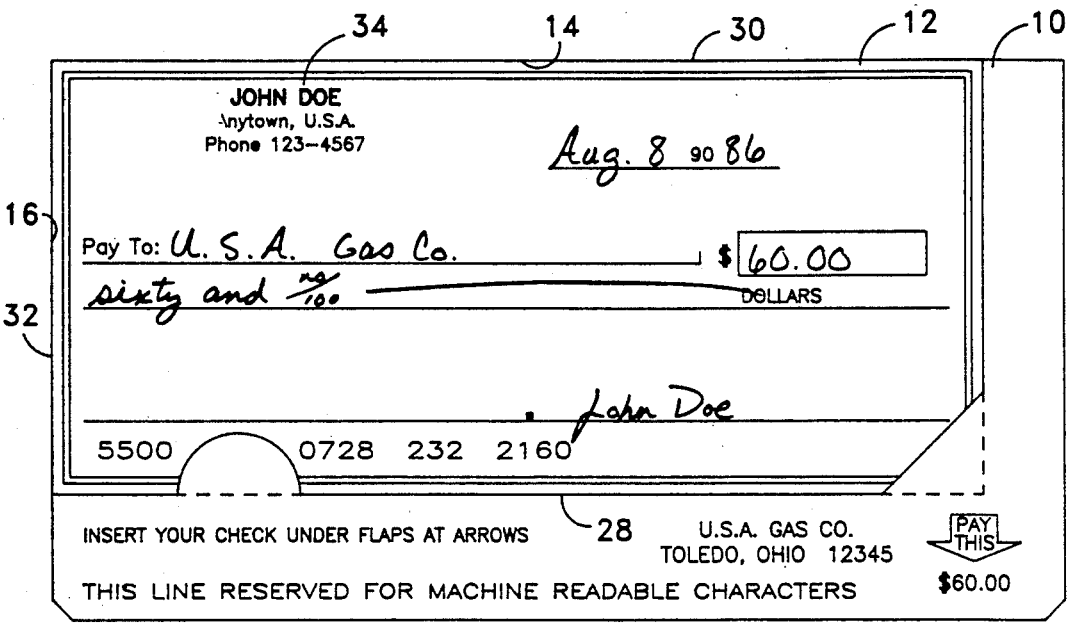
FIG. 2 is drawing of the same bill and check as shown in FIG. 1 after the check is affixed to the bill and the assembly is ready for insertion in a mailing envelope.

The bottom support slit 18 and the corner slit 20 are located so that the upper marginal edge 14 of the check is a predetermined distance above the lower edge of the bill and preferably substantially aligned with the upper marginal edge 30 of the bill as illustrated in FIG. 2. The corner slit 20 prevents lateral movement of the check to the right and is located so that the left marginal edge 16 of the check 12 is substantially aligned with the left marginal edge 32 of the bill 10. The information field 34 on the check 12 which has the address identification is fixedly located relative to the four marginal edges of the bill 10. The numerals 60.00 on the check are in close proximity to the same numerals on the bill which indicate the amount to be paid.

Figure 3:
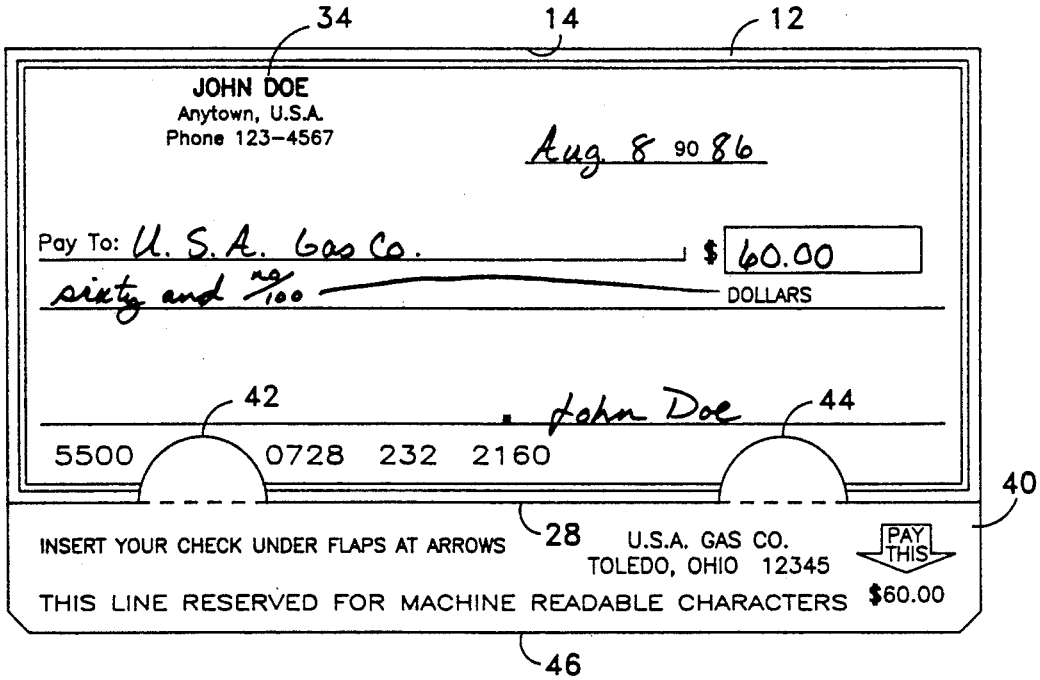
FIG. 3 is a similar to FIG. 2 showing a second embodiment when the bill payment is narrower than in the embodiment of FIG. 2 thereby to have the same width as that of the check.

As an alternative embodiment, the bill 40 may have a width that is equal to the width of the check 12 as shown in FIG. 3. The notation "pay this" and the numerals indicating the amount to be paid are thus near the lower margin of the bill and at a location below the lower marginal edge 28 of the check 12. The numerals 60.00 indicating the amount of the check are in vertical alignment with and remain in close proximity to the notation on the bill indicating the amount to be paid.

In the embodiment illustrated in FIG. 3, a corner slit is not needed and both bottom support slits producing flaps 42, 44 are located to position the top edge 14 of the check 12 at a fixed distance from the bottom edge 46 of the bill 40 and preferably, but not necessarily, aligned with the upper edge of bill 40. The position of the address information field 34 is thereby fixedly located with respect to the marginal edges of the bill.

Figure 4:
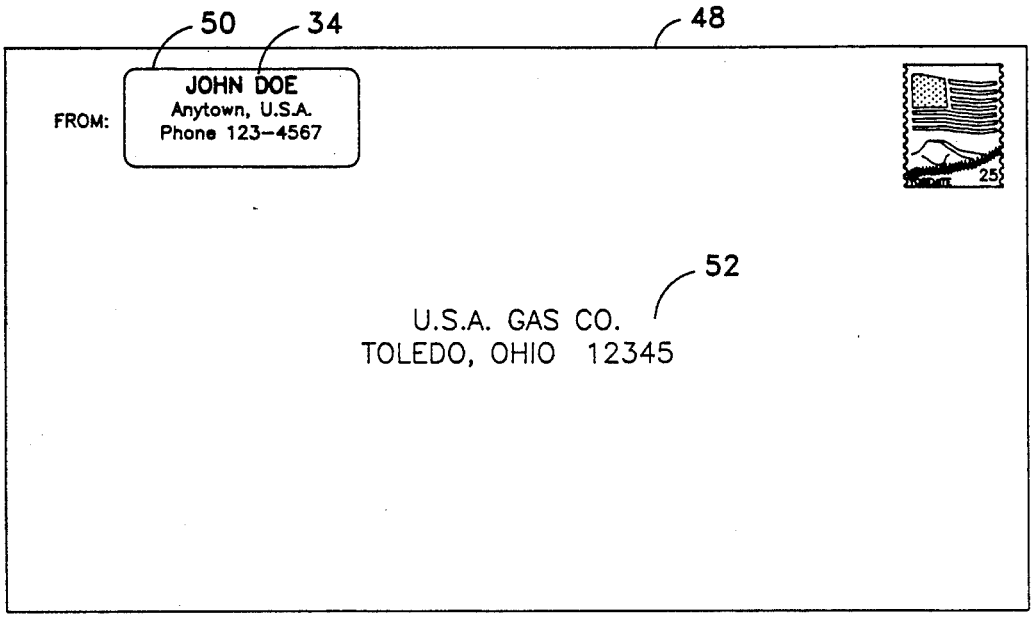
FIG. 4 is drawing of an envelope that is preaddressed to the payment processing center for containing the assembled payment/bill and check.

FIG. 4 illustrates a novel envelope which has marginal edges dimensioned to match the size of the bill and check assembly. The envelope has a width of six inches with the bill assembly of FIG. 3 and slightly greater with the bill assembly of FIG. 2. The return address portion of the envelope 4 is diecut to form a window 50 which may be open or covered by a transparent glassine sheet. The address identification information field 34 on check 12 is visible through the window thereby obviating the need of the check writer to place a return address on the envelope.

Envelope 48 is shown to have a preprinted address 52 rather than a window because if the check should fall to the bottom of the envelope, the address on a bill normally visible through the window could become obscured by the check and impede the normal delivery of the envelope.

Figure 5:
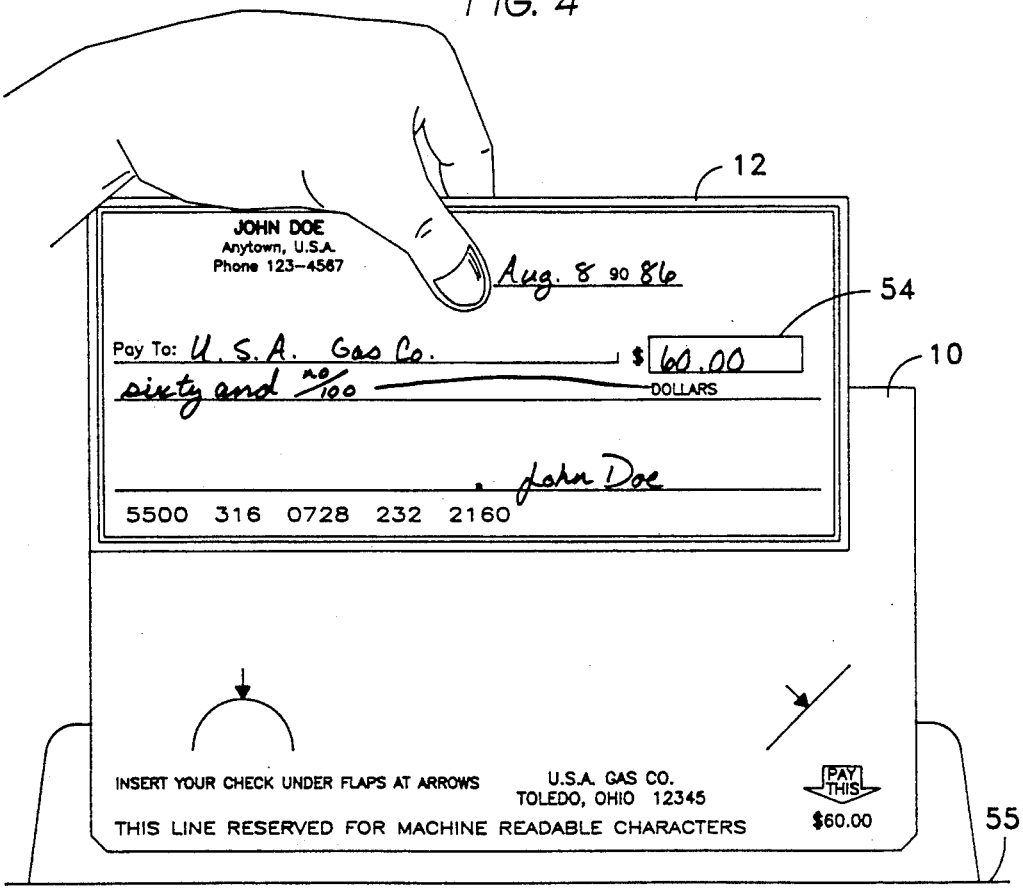
FIG. 5 is a drawing showing a check being separated from the payment bill as the bill drops to a conveyor which is in the payment processing center.

FIG. 5 illustrates an operation which takes place after the envelope has been opened and discarded. An important feature of the present invention is that because the return address for the envelope is provided by the address information on the check, the bill and check are highly likely to be received with the surfaces having the relevant information facing the person who discards the envelope with the check on top of the bill. The need for turning over either document is eliminated. Reorientation of the check relative to the bill is unnecessary. Satisfactory operation without the need for a person may become possible with suitable automated equipment.

In the payment process center it is normal for an operator to remove a bill and check from the envelope and drop first the bill into an optical reading machine and then the check while at the same time reading the payment amount 54 from the check. In some processing centers, the check amount is keyed into the processor.

As is illustrated in FIG. 5, the hand of the operator grasps the assemblage of the bill 10 and check 12 and with a downward sliding motion of the fingers, the bill 10 moves downward into a waiting transport 55 while the thumb retains the check 12 so that the check may be dropped into the transport immediately following the bill 10 but not until after the person has read and, if necessary, keyed in the check amount. Alternatively, the check and bill may be dropped into equipment which uses a lateral sliding motion to cause the separation.

In the prior art, the bill normally faces the diecut portion of the envelope and comes out of the envelope with the check located behind the bill. The operator must then drop the bill before the payment amount on the check can be seen or a decision is made concerning whether the check must be turned over, reoriented or both.

The benefit of having the check emerge from the envelope rightside up and facing the operator and being the first document see is a goal of the present invention. By use of the novel bill having the check supporting diecuts that locate the address identification information at the return to sender address location of the envelope encourages the desired check and bill orientation so that a substantial increase in operator productivity at the payment processing center may be achieved when measured over the course of the working day.

While two embodiments of my invention have been described, other changes and variations will occur using the concept of the present invention. All changes and equivalents which fall within the scope of the appended claims are intended to be covered thereby.

I claim:

1. A remittance containing envelope having a personal check preprinted with address identification information and a bill on an unfolded single sheet adapted for automated processing, a dimension of the bill in at least one direction being larger than the corresponding dimension of the check and the two dimensions of the bill being substantially equal to the corresponding dimensions of the envelope;

said envelope containing a window at a location where a return address is positioned;

means for affixing said check on said bill so that when the bill and check are properly inserted in the envelope, the address identification information on the check is visible through said window as a return address for the envelope.

2. The remittance containing envelope as defined in claim 1 wherein said bill contains a notation indicating an amount to be paid positioned in close proximity to the numerals on the check indicating the amount of the check to allow simultaneous observation of the check payment amount and the bill notation without turnover or reorientation of the check relative to the bill

3. The remittance containing envelope as defined in claim 2 wherein the check is affixed to the bill in a manner that the check and bill are readily separable after removal from an upper open edge of the envelope by sliding movement parallel to the larger dimension of the bill.

4. The remittance containing envelope as defined in claim 2 wherein the check and bill are readily separable after removal from an upper open edge of the envelope by sliding movement that is perpendicular to the larger dimension of said bill.

5. In combination, a bill on a sheet of material for services or merchandise directed to a consumer, said bill having a major dimension in a writing direction and a minor dimension in a direction perpendicular thereto and containing a notation indicating an amount to be paid on a surface thereof;

a personal check blank belonging to the consumer having a major dimension in a writing direction that is parallel to a first marginal edge wherein the money value of the check in digits is located on the face of the check at a right hand side of the check;

means associated with the bill to affix the first marginal edge of the check parallel to the major dimension of and at a central position on said bill so that the money value of the check and the bill notation are in close proximity while the bill and check are placed into and removed from a mailing envelope; and means to prevent vertical movement of the check relative to the bill while the bill and check are transported in the mailing envelope whereby upon removal from the mailing envelope, the bill and check can be simultaneously observed without turnover or reorientation of the check relative to the bill and the check and bill are readily separable after removal from an upper open edge of the envelope by a relative sliding movement.

6. The combination as defined in claim 5 wherein the bill affixing means comprises die cuts forming flaps which engage the face of the check.

7. The combination as defined in claim 6 wherein one diecut engages two marginal edges of the personal check to prevent lateral movement of the check in one direction relative to the bill.

8. The combination as defined in claim 7 wherein the envelope contains a window at a return address location and address identification information on said check is visible through said envelope window.

9. The combination as defined in claim 6 wherein major dimensions of the bill and check are equal and equal to a corresponding dimension of said envelope thereby to prevent lateral movement of the check relative to the bill while the bill and check are transported by mail.

10. The combination as defined in claim 9 wherein the envelope contains a window at a return address location and address identification information on said check is visible through said envelope window.

11. An envelope preprinted with a payment processing center address containing a bill and a personal check preprinted with address identification information for payment of said bill wherein:

the bill has a structure for locating the check at a predetermined position on one side of the bill relative to at least one edge of said bill;

said bill further contains a marking which identifies the amount of the bill at a location on said one side that is visible when the check is located at said predetermined position;

said bill has marginal edges that fit snugly within edges of the envelope;

said envelope has a window at a position where a return address appears; and said check is engaged by said bill structure and positioned inside said envelope adjacent said window so that address identification information on said check is visible to serve as a return address for said envelope.

* * * * *